US011293271B1

(12) United States Patent
Hoelscher et al.

(10) Patent No.: US 11,293,271 B1
(45) Date of Patent: Apr. 5, 2022

(54) LOW-PROFILE ADJUSTABLE FASTENER FOR CHARGE ORIENTATION OF A DOWNHOLE PERFORATING TOOL

(71) Applicant: Halliburton Energy Services, Inc., Houston, TX (US)

(72) Inventors: Christopher C. Hoelscher, Arlington, TX (US); Camille Anne Bryant, Cleburne, TX (US); Nicholas Peter LeClair, Kennedale, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/082,421

(22) Filed: Oct. 28, 2020

(51) Int. Cl.

| | |
|---|---|
| ***E21B 43/119*** | (2006.01) |
| ***E21B 43/117*** | (2006.01) |
| ***E21B 19/16*** | (2006.01) |
| ***E21B 34/10*** | (2006.01) |

(52) U.S. Cl.
CPC ..... *E21B 43/119* (2013.01); *E21B 19/16* (2013.01); *E21B 34/103* (2013.01); *E21B 43/117* (2013.01)

(58) Field of Classification Search
CPC ..... E21B 43/119; E21B 43/117; E21B 19/16; E21B 34/103
See application file for complete search history.

(56) References Cited

U.S. PATENT DOCUMENTS

| | | | |
|---|---|---|---|
| 7,114,564 | B2 | 10/2006 | Parrott et al. |
| 7,647,978 | B2 | 1/2010 | Scott |
| 8,061,425 | B2 | 11/2011 | Hales et al. |
| 8,424,606 | B2 * | 4/2013 | Zhan ..... E21B 43/1195 166/297 |
| 9,382,784 | B1 | 7/2016 | Hardesty et al. |
| 10,422,195 | B2 * | 9/2019 | LaGrange ..... E21B 29/02 |
| 10,689,955 | B1 * | 6/2020 | Mauldin ..... E21B 43/119 |

(Continued)

FOREIGN PATENT DOCUMENTS

| | | |
|---|---|---|
| GB | 2399583 | 9/2004 |
| GB | 2546061 | 12/2017 |
| WO | 2009-120980 | 10/2009 |

OTHER PUBLICATIONS

CoreLab Reservoir Optimization, Owen Oil Tools—Zero180 product line, available at https://www.corelab.com/owen? utm_source=mv&utm_medium=paid&utm_campaign=intent&gclid=EAlalQobChMlrpPr_q7p6wlVUr7ACh2iOwCfEAAYASAAEgK3tvD_BwE&gclsrc=aw.ds, accessed Sep. 1, 2020.

(Continued)

*Primary Examiner* — Yong-Suk (Philip) Ro
(74) *Attorney, Agent, or Firm* — John Wustenberg; C. Tumey Law Group PLLC

(57) ABSTRACT

Systems and methods of the present disclosure relate to a low-profile adjustable fastener for charge orientation of a downhole perforating tool. The perforating tool may include a first tubular comprising apertures; a second tubular comprising apertures, the first tubular disposed in the second tubular, wherein the apertures of the first tubular are configured to align with the apertures of the second tubular upon movement of the first tubular; and a fastener comprising: a first component configured to pass through the apertures on a first side of each of the first and second tubulars; and a second component configured to pass through the apertures on a second side of each of the first and second tubulars.

20 Claims, 4 Drawing Sheets

(56) References Cited

U.S. PATENT DOCUMENTS

| | | | | |
|---|---|---|---|---|
| 2010/0300750 | A1 | 12/2010 | Hales et al. | |
| 2011/0094744 | A1 | 4/2011 | Hales et al. | |
| 2015/0226044 | A1 | 8/2015 | Ursi et al. | |
| 2017/0211363 | A1* | 7/2017 | Bradley | E21B 43/117 |
| 2018/0363423 | A1 | 12/2018 | Hradecky | |
| 2019/0040726 | A1 | 2/2019 | Deutch et al. | |

OTHER PUBLICATIONS

WP—G-Force product line, available at https://www.gorbel.com/education/ergonomic-lifting/capabilities, accessed Sep. 1, 2020.
International Search Report and Written Opinion for Application No. PCT/US2020/058376, dated Jul. 8, 2021.

* cited by examiner

LOW-PROFILE ADJUSTABLE FASTENER FOR CHARGE ORIENTATION OF A DOWNHOLE PERFORATING TOOL

BACKGROUND

After drilling various sections of a wellbore that traverse a subterranean formation, individual metal tubulars may be secured together to form a casing string that is cemented within the wellbore. The casing string may provide a path for fluids to flow from producing subterranean intervals to the surface. To allow the fluids into the casing string, the casing string may be perforated.

Typically, the perforations may be created by detonating a series of charges within the casing string. Specifically, one or more charge carriers may be loaded with the charges. The charge carriers may then be secured within a tool string that is lowered into the casing string. Once the charge carriers are positioned at a desired depth, the charges may be detonated. Upon detonation, the charges may form jets that may cause perforations through the casing string, the cement, and a portion of the subterranean formation. In some wellbores, perforating in a particular direction or range of directions relative to the wellbore may be desired.

BRIEF DESCRIPTION OF THE DRAWINGS

These drawings illustrate certain aspects of some examples of the present disclosure and should not be used to limit or define the disclosure.

DETAILED DESCRIPTION

The present disclosure generally relates to techniques for attaching a weight tube to a charge tube of an internally oriented perforating tool. In particular examples, a desired angle of charge orientation may be set by coupling the weight tube to the charge tube with a low-profile mechanical fastening device. The fastening device may provide 360° of rotational freedom for adjusting angles of the charge orientation.

In certain examples, the fastening device may include a barrel nut and a threaded member such as a barrel bolt, to fasten the weight tube to the charge tube. This may allow the charge tube to be adjusted to various angles, as desired. The barrel nut and the threaded member may allow the weight tube to be fastened to the charge tube without finger pinch points on interior portions of the weight and charge tubes. The barrel nut and threaded member may also maintain a low profile on the outside of the charge tube that does not impede the rotation of the charge tube.

In some examples, additional threads may not be required to be machined into the weight tube in order to secure it to the charge tube. Special tools may not be required to adjust the weight tube to a different angle, in the field. The threaded member and barrel nut may include a range of outer and inner diameter sizes which may allow for less stringent tolerances when designing and manufacturing different components such as the charge tube and the weight tube, for example.

In particular examples, an array of apertures may be arranged on the weight tube and the charge tube to provide adjustability of the angular position of the charge tube. This array of apertures may be utilized to receive a fastener therethrough to secure the angular position of the charge tube relative to the weight tube. The size and number of rows of apertures may be configured in several ways to provide 360° of adjustability.

The single fastener connection may eliminate a need for multiple screws and nuts to connect the charge tube to the weight tube, thereby increasing efficiency for both initial assembly and subsequent adjustment thereto. In some examples, the fastener may include a push-pin mechanism.

Additionally, an inside of the charge tube does not need to be accessed to make-up the fastener. This single connection may employ a restraint of six degrees of freedom (DOF) in translational and rotational motion with two points of contact. The two points of contact may be accessible on the outside of the charge tube.

Figure 1:
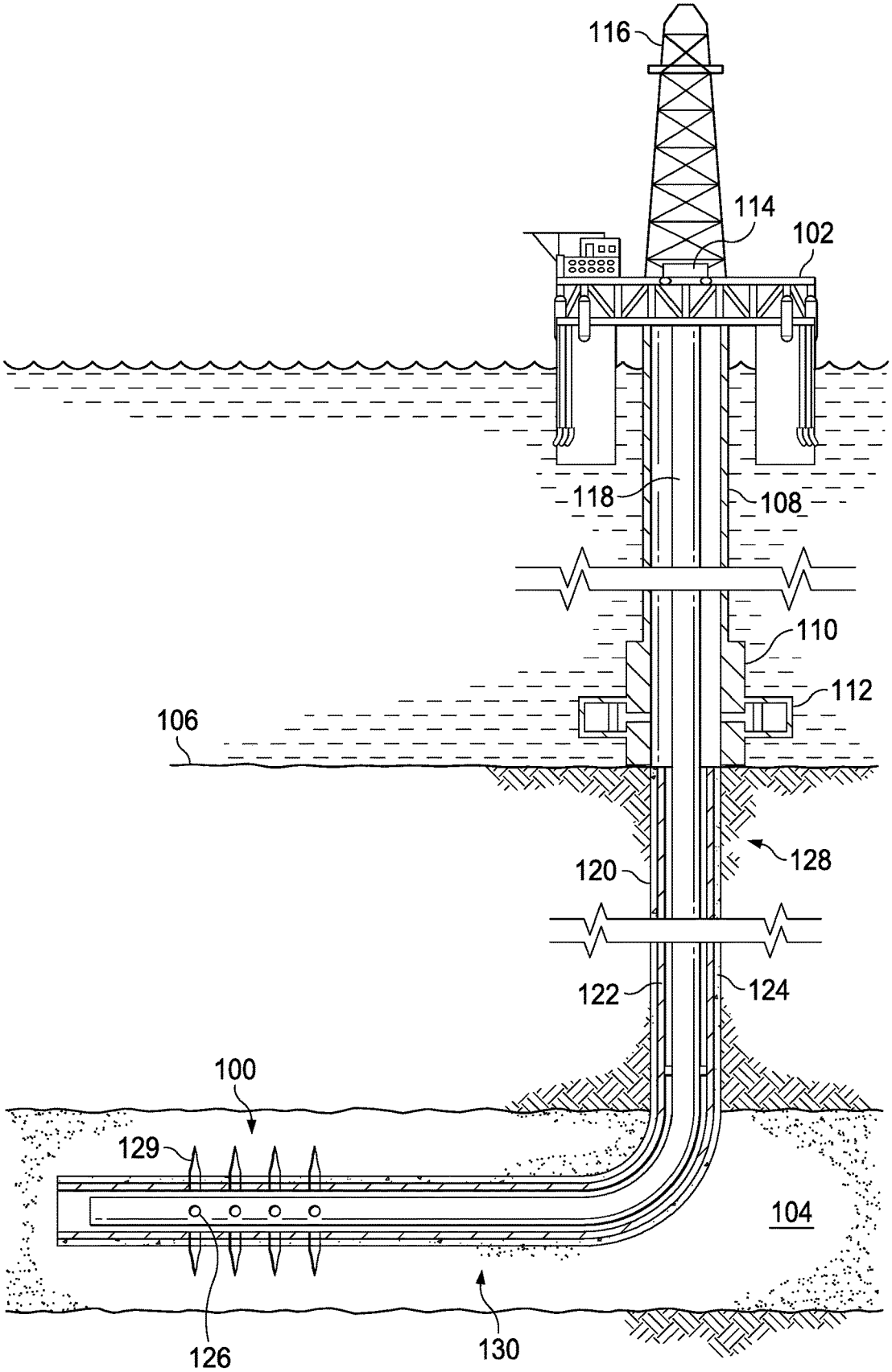
FIG. 1 illustrates an operating environment for a perforating tool, in accordance with examples of the present disclosure.

FIG. 1 illustrates an operating environment for a perforating tool 100, in accordance with examples of the present disclosure. A semi-submersible platform ("platform 102") may be centered over a submerged oil and gas formation 104 that may be located below a sea floor 106. A subsea conduit 108 may extend from the platform 102 to a wellhead installation 110 which may include subsea blow-out preventers 112. The platform 102 may include a hoisting apparatus 114 and a derrick 116 for raising and lowering pipe strings such as a work string 118 which may include the perforating tool 100. The work string 118 may also include a conveyance such as a wireline, slickline, coiled tubing, pipe, or downhole tractor, which may provide mechanical suspension, as well as electrical connectivity, for the perforating tool 100, for example. It should be understood that the configuration of the perforating tool 100 shown on FIG. 1 is merely illustrative and other configurations of the perforating tool 100 may be utilized with the present techniques. For example, although FIG. 1 depicts an offshore environment, systems and methods of the present disclosure may also be utilized onshore.

A wellbore 120 may extend through various earth strata including the formation 114. A casing string 122 may be cemented within the wellbore 120 by cement 124. The wellbore 120 may include an initial, generally vertical portion 128 and a lower, generally deviated portion 130 which is illustrated as being horizontal. It should be noted, however, by those skilled in the art that the perforating tool 100 may also be suited for use in other well configurations including, but not limited to, inclined wells, wells with restrictions, non-deviated wells, and/or multilateral wells, for example.

The perforating tool 100 may include various tools such as a plurality of perforating apparatuses or guns 126. To perforate the casing string 122, the perforating tool 100 may be lowered in the casing string 122 until the perforating guns 126 are properly positioned relative to the formation 104.

Thereafter, in some examples, shaped charges (not shown) within the perforating guns 126 are detonated. Upon detonation, liners of the shaped charges may form a spaced series of perforations 129 extending outwardly through the casing string 122, the cement 124, and into the formation 104, thereby allowing fluid communication between the formation 104 and the wellbore 120.

Figure 2A:
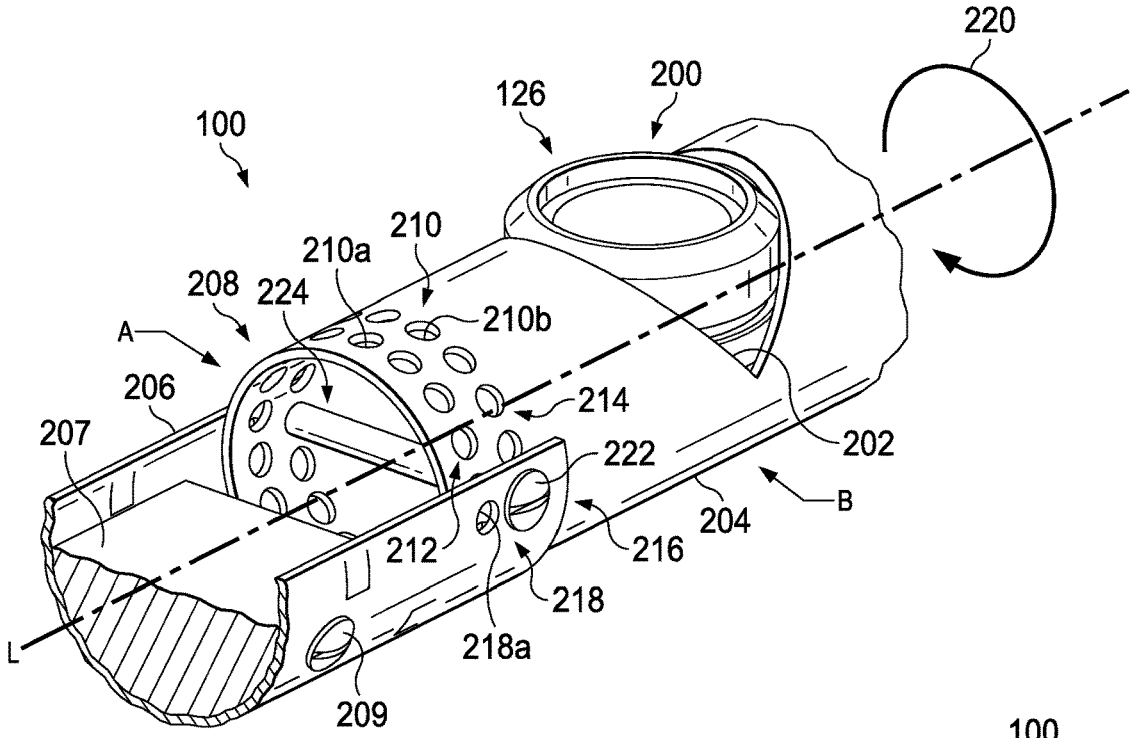
FIG. 2A illustrates a close-up perspective side view of the perforating tool, in accordance with examples of the present disclosure.

FIG. 2A illustrates a close-up perspective side view of internals of the perforating tool 100, in accordance with examples of the present disclosure. As illustrated, the perforating tool 100 may include a perforating gun 126. In the illustrated embodiment, the perforating gun 126 may include a shaped charge 200, a charge tube 204, and a weight tube 206. The shaped charge 200 should be generally operable to perforate the well upon detonation. For example, the shaped charge 200 may generate jets that extend outwardly from the perforating gun 126 to generate perforation tunnels that extend through casing, cement, and/or the subterranean formation. Any of a variety of explosive devices may be used as the shaped charge 200 as should be appreciated by those of ordinary skill with the benefit of the present disclosure. While only a single shaped charge 200 is shown, the perforating gun 126 may include two or more of the shaped charges 200 as may be desired for a particular application.

The shaped charge 200 may be secured within recesses or pockets 202 of the charge tube 204, for example. The charge tube 204 may also be referred to as a charge holder. The pockets 202 may include any suitable shape such a cylindrical, for example, to contain the shaped charge 200. The charge tube 204 may be an elongated tubular member made of metal, for example. The diameter of the charge tube 204 may be determined by a number of factors, including, but not limited to, the gun carrier body (not shown) that may house the charge tube 204 and the weight tube 206, and a size of the charges being used in the system. The length of the charge tube may depend on a number of factors, including, but not limited to, the amount of charges being used and the required spacing between the individual charges. Non-limiting examples of dimensions of the charge tube 204 include a length ranging from 15 centimeters (cm) to 975 cm; an outer diameter ranging from 9.5 millimeters (mm) to 380 mm; and a wall thickness ranging from 0.56 mm to 16.5 mm. Dimensions of the weight tube 206 may complement and/or correspond with the dimensions of the charge tube 204 to allow proper fitting, as should be understood by one having skill in the art with the benefit of this disclosure.

The charge tube 204 may be coupled to the weight tube 206. The weight tube 206 may be an elongated tubular member made of metal, for example. In some examples, the weight tube 206 may include the shape of a semi-cylinder or half of a cylinder divided longitudinally. In some examples, the weight tube 206 may be slightly larger than the charge tube 204 such that the weight tube 206 may slide over the charge tube 204 with minimal slope between the parts.

The charge tube 204 and the weight tube 206 may be made from cylindrical tubing, for example. However, it should be understood that the charge tube 204 and the weight tube 206 may be of any suitable shape such as a full cylinders, as should be understood by those having skill in the art with the benefit of this disclosure.

In some examples, the weight tube 206 may include a removable weight 207 which may be utilized to adjust the center of gravity of the charge tube 204, as should be understood by one having skill in the art with the benefit of this disclosure. The weight 207 may be attached to the weight tube 206 via a fastener 209 which may include a screw, bolt, weld, and/or tab on at least one side of the weight tube 206, for example.

The weight 207 may be formed from any suitable material as should be understood by one having skill in the art with the benefit of this disclosure. For example, the weight may include a block of metal or concrete. In some examples, a plurality of discrete weights may be individually removably coupled to the weight tube 206 at various locations extending lengthwise along the weight tube 206. A size of the weight 207 may depend on a size of the charge tube 204 and may be sized accordingly, as should be understood by one having skill in the art with the benefit of this disclosure.

In some examples, an end 208 of the charge tube 204 may include apertures 210 corresponding to different rotational angles, relative to the weight tube 206. The apertures 210 may be of any suitable shape, such as circular for example, and may be disposed along a circumference of the end 208 of the charge tube 204, as shown.

In some examples, the apertures 210 may be arranged in adjacent rows that extend along the circumference of the end 208. A first row 212 may include increments for rotational adjustment (e.g., degrees) that are staggered with increments for rotational adjustment of the second row 214. For example, the first row 212 may include apertures 210*a* that correspond with rotational positions of 200°, 220°, and 240°, whereas the second row 214 may include apertures 210*b* that correspond with in-between or staggered rotational positions such as 210° and 230°, for example. In certain examples, the apertures 210 may be arranged in alternating spaced arrays that provide angle adjustments in increments that may range from 2° to 90° about the 360° range. A diameter of each aperture 210 may range from 0.318 cm to 1.27 cm, in some examples.

In some examples, an end 216 of the weight tube 206 may include corresponding apertures 218 that are disposed on opposite lateral sides A and B of the weight tube 206. The apertures 218 of the weight tube 206 may include sizes similar to those of the apertures 210 of the charge tube 204, for example. Each side A or B of the weight tube 206 may include at least two apertures including an aperture 218*a* and a non-visible aperture covered with a head 222 of a fastener 224. As illustrated, the fastener 224 extends from side A to side B of the weight tube 206. In some examples, the apertures 218 on each side A or B may be adjacent to one another in a longitudinal direction. Each aperture 218 on each side of the weight tube 206 may be configured to correspond with an aperture 210*a* or an aperture 210*b* of the charge tube 204. In some examples, the staggered configuration of the apertures 210 may prevent alignment between an aperture 210*a* and an aperture 218 during alignment of an aperture 210*b* and an aperture 218, as illustrated.

The charge tube 204 may be rotated clockwise or counterclockwise about a longitudinal axis or axis of rotation, L, of the perforating tool 100, as indicated by a directional arrow 220, for example. In certain examples, an outer diameter of the charge tube 204 may be slightly less than an inner diameter of the weight tube 206, such that the end 208 of the charge tube 204 may be positioned within the end 216 of the weight tube 206 and rotated to a desired position. Upon moving, adjusting, or rotating the charge tube 204 to the desired position such that a pair of apertures 218 of the weight tube 206 align with a pair the apertures 210 of the charge tube 204, the fastener 224 may be placed through the pairs of apertures 210 and 218 to secure the charge tube 204 to the weight tube 206 in the desired position, as illustrated.

Figure 2B:
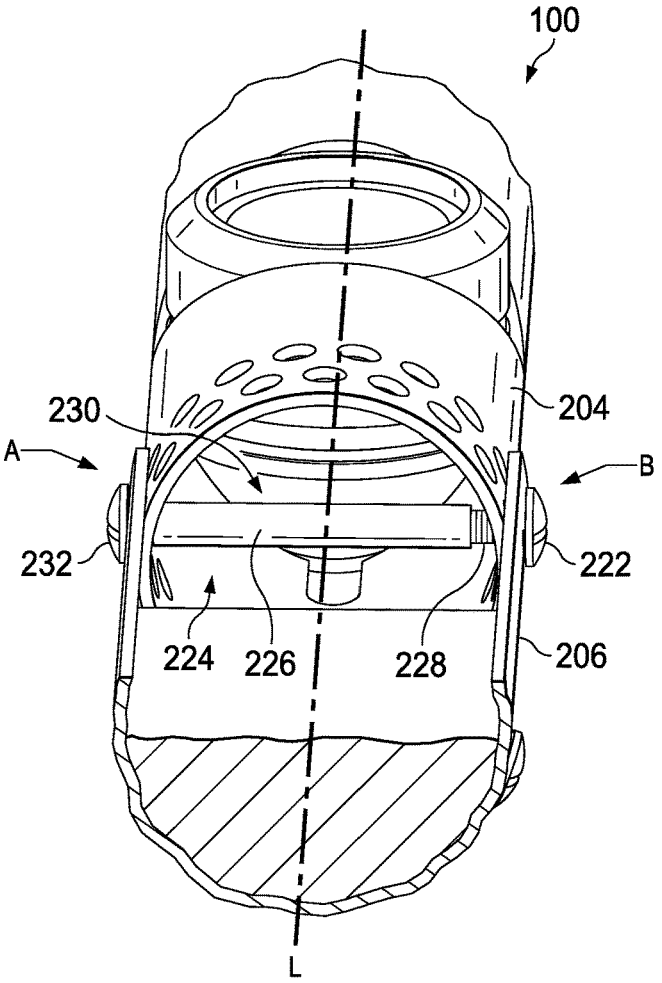
FIG. 2B illustrates a close-up view of a fastener traversing interior portions of the perforating tool, in accordance with examples of the present disclosure.

FIG. 2B illustrates a close-up view of the fastener 224 traversing interior portions of the charge tube 204 and the weight tube 206 in a direction that is lateral to the L, in accordance with examples of the present disclosure. As previously noted, the fastener 224 may include a barrel nut 226 and a threaded member 228. In some non-limiting examples, the apertures 210 (e.g., shown on FIG. 2A) may be 1.025 times to 1.2 times larger than the diameter of the barrel nut 226 and the threaded member 228.

The threaded member 228 may be threaded into the barrel nut 226 to secure a position of the charge tube 204 relative to the weight tube 206 to allow the shaped charge 200 (e.g., shown on FIG. 2A) to detonate in a desired direction.

The barrel nut 226 may be inserted into an aperture 210 on side A or B of the weight tube 206 and an aperture 218 on the corresponding side of the charge tube 204, as shown. On an opposite side of the weight tube 206, the threaded member 228 may be inserted into a corresponding aperture 218 of the weight tube 206 and then the corresponding aperture 210 of the charge tube 204, such that the threaded member 228 is secured to the barrel nut 226 within an interior portion 230 of the charge tube 204, as illustrated. The head 222 of the threaded member 228 may be tightened against an exterior of the weight tube 206. A head 232 of the barrel nut 226 may also be tightened against an opposite exterior side of the weight tube 206. In some examples, the heads 222 and 232 may each include a contoured surface (e.g., a recess) to receive an end of a tool such as a screw driver or wrench (not shown) for tightening or loosening the threaded member 228 from the barrel nut 226.

Figure 3A:
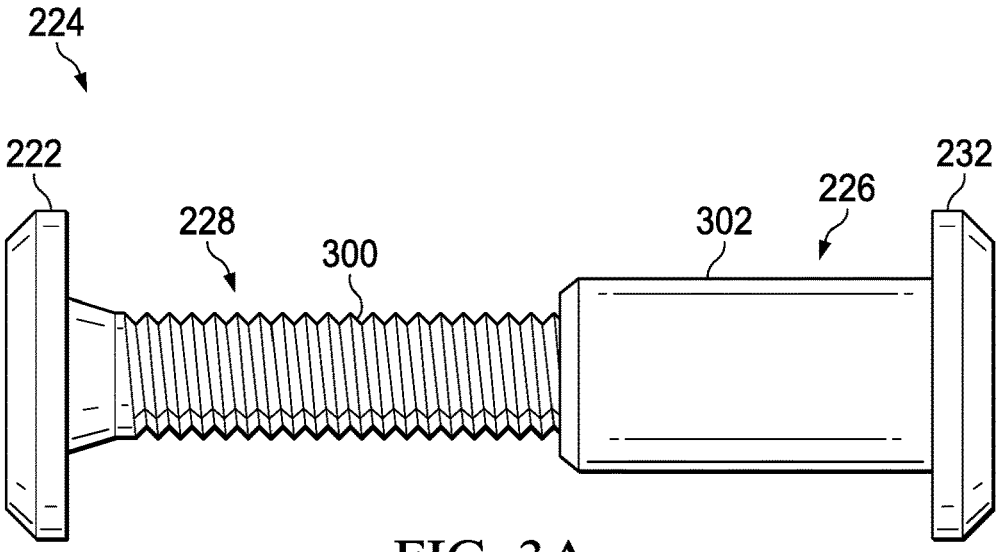
FIG. 3A illustrates a close-up view of the fastener, in accordance with examples of the present disclosure.

FIG. 3A illustrates a close-up view of the fastener 224, in accordance with examples of the present disclosure. As noted previously, the fastener 224 may include two separate components that may be threaded together: the threaded member 228 may be secured to the barrel nut 226.

The threaded member 228 may include a threaded segment 300 extending longitudinally from the head 222. The span between the head 222 of the threaded member 228 and the head 232 of the barrel nut 226 may be at a minimum, the length of the OD of the weight tube 206 (e.g., shown on FIG. 2A) or the charge tube 204 (e.g., shown on FIG. 2A) if the weight tube 206 is designed to fit inside the charge tube 204 instead of on the outside. The diameter of the heads 222 and 232 of the threaded member 228 and barrel nut 226 may be in the range of 1.25 to 2.5 times greater than the aperture size in the charge tube 204. The barrel nut 226 may include an elongated cylindrical or barrel portion 302 extending from the head 232.

The barrel portion 302 may be hollow and include a threaded inner surface to receive at least a portion of the threaded segment 300 during tightening of the fastener 224. The fastener 224 may be formed from any suitable material such as metal, for example. Non-limiting examples of the metal may include steel, nickel, aluminum, titanium, or combinations thereof.

In non-limiting examples, the barrel nut 226 attached to the threaded member 228 may span a distance ranging from 2 inches to 8 inches (5 centimeters (cm) to 10 cm). The barrel nut 226 may include a length ranging from 2 to 6 inches (5 cm to 8 cm); a diameter ranging from 0.25 inch to 0.6 inch (0.6 cm to 1.5 cm); a thread depth ranging from 0.2 to 0.5 inch (0.5 cm to 1.3 cm); a head diameter ranging from 0.2 inch to 0.75 inch (0.5 cm to 2 cm); and a head thickness ranging from 0.06 inch to 0.4 inch (0.15 cm to 0.32 cm) to maintain the low profile. The threaded member 228 may include similar and/or corresponding dimensions. It should be noted that these are non-limiting dimensions, and other dimensions may be utilized as should be understood by one having skill in the art with the benefit of this disclosure.

Figure 3B:
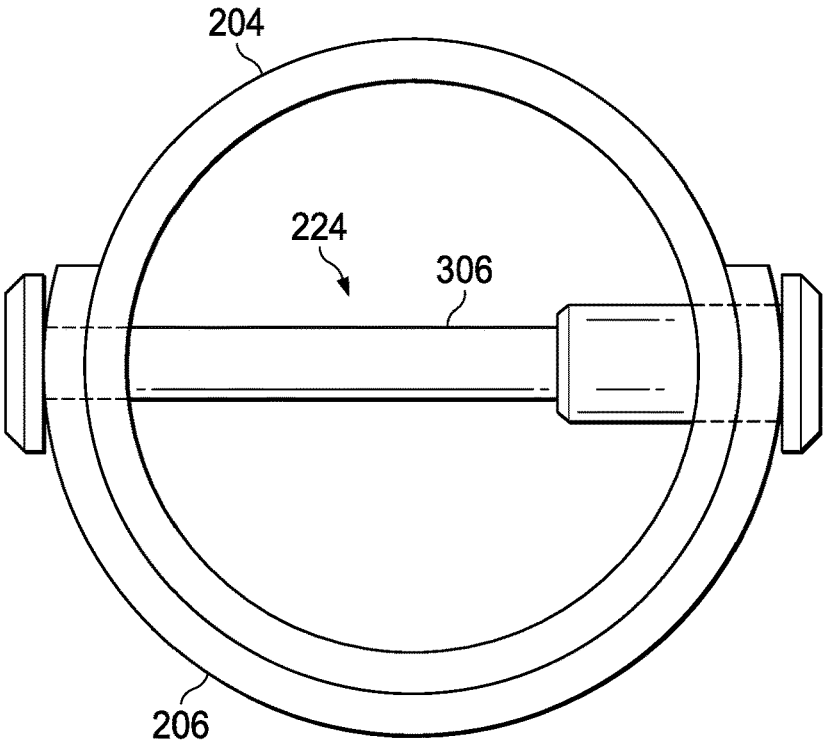
FIG. 3B illustrates the fastener including a push pin or rivet mechanism, in accordance with examples of the present disclosure.

FIG. 3B illustrates an alternate configuration of the fastener 224, in accordance with examples of the present disclosure. In some examples, the fastener 224 may include an elongated member 306 such as a rivet or a push pin extending laterally through portions of the weight tube 206 and the charge tube 204, for example. In some examples, the member 306 may replace the threaded member 228 and the barrel nut 226 (e.g., shown on FIG. 3A).

Figure 4:
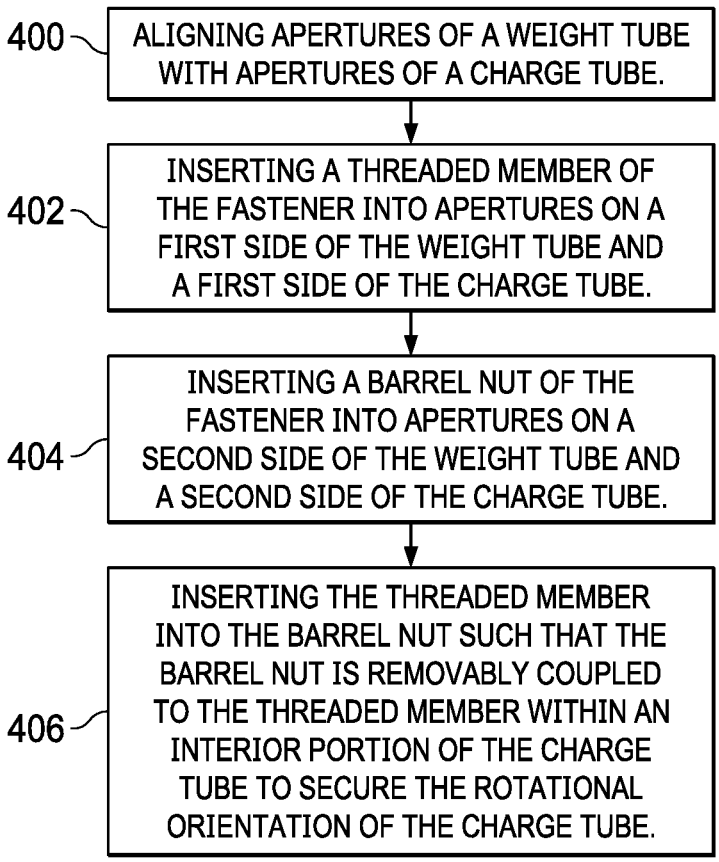
FIG. 4 illustrates a flow chart for internally orienting a charge tube of the perforating tool, in accordance with examples of the present disclosure.

FIG. 4 illustrates a sequence for internally orienting a charge tube of a perforating tool, in accordance with particular examples of the present disclosure. At step 400, the charge tube 204 of the perforating tool 100 may be moved (e.g., rotated) to align the apertures 210 on the charge tube 204 with the apertures 218 of the weight tube 206, as shown on FIGS. 2A and 2B, for example. At step 402, the threaded member 228 of the fastener 224 may be inserted into an aperture 218 on a first side of the weight tube 206 and an aperture 210 on a first side of the charge tube 204. At step 404, the barrel nut 226 may be inserted into an aperture 218 on a second side of the weight tube 206 and an aperture 210 on a second side of the charge tube 204. At step 406, the threaded member 228 may be threaded into the barrel nut 226 such that the barrel nut 226 is removably coupled to the threaded member within the interior portion 230 of the charge tube 204, and rotational orientation of the charge tube 204 is secured, as shown on FIGS. 2A and 2B, for example. Once secured, the perforating tool 100 may be disposed downhole for perforation operations, as shown on FIG. 1 for example.

Accordingly, the systems and methods of the present disclosure may allow for 360° of adjustability to position and secure a charge tube, with a two-component low-profile fastener that may be accessible from the outside of the charge tube. The systems and methods may include any of the various features disclosed herein, including one or more of the following statements.

Statement 1. A perforating tool comprising: a first tubular comprising an end including apertures extending along a circumference of the end; a second tubular comprising apertures disposed on opposing sides of an end of the second tubular, the end of the first tubular disposed in the end of the second tubular, wherein the apertures of the first tubular are configured to align with the apertures of the second tubular upon movement of the first tubular; and a fastener comprising: a first component configured to pass through the apertures on a first side of each of the first and second tubulars; and a second component configured to pass through the apertures on a second side of each of the first and second tubulars, wherein the second component is configured to receive the first component in an interior portion of the first tubular, wherein the second component and the first component are configured to secure an orientation angle of the first tubular relative to the second tubular.

Statement 2. The tool of the statement 1, wherein the first component includes a threaded member.

Statement 3. The tool of any one of the preceding statements, wherein the second component includes a barrel nut.

Statement 4. The tool of any one of the preceding statements, wherein the apertures of the first tubular are arranged in rows.

Statement 5. The tool of any one of the preceding statements, wherein each aperture of the first tubular corresponds with an orientation angle for the first tubular relative to the second tubular.

Statement 6. The tool of any one of the preceding statements, wherein the first tubular is 360° rotatable relative to the second tubular before fastening of the first tubular to the second tubular with the fastener.

Statement 7. The tool of any one of the preceding statements, wherein the first component comprises a push pin or a rivet.

Statement 8. The tool of any one of the preceding statements, wherein the fastener extends laterally into the first and second tubulars from opposite sides of the perforating tool.

Statement 9. A downhole perforating system comprising: a charge tube comprising apertures extending along a circumference of the charge tube; a weight tube comprising apertures disposed on opposing sides of the weight tube, the weight tube configured to adjust a center of gravity of the charge tube, wherein a portion of the charge tube is disposed in the weight tube, wherein the apertures of the charge tube are configured to align with the apertures of the weight tube upon movement of the charge tube or the weight tube; and a fastener comprising: an elongated member extending through the apertures of each of the charge tube and weight tube, wherein the elongated member secures an orientation angle of the charge tube.

Statement 10. The system of the statement 9, wherein the apertures of the charge tube correspond with orientations angles of the charge tube ranging from 0° to 360° relative to the weight tube.

Statement 11. The system of the statement 9 or 10, wherein the charge tube comprises at least one shaped charge.

Statement 12. The system of any one of the statements 9-11, wherein the weight tube comprises an adjustable weight.

Statement 13. The system of any one of the statements 9-12, wherein the apertures of the charge tube are arranged in staggered rows, each aperture of the charge tube corresponding with detonation orientation.

Statement 14. The system of any one of the statements 9-13, wherein the first component comprises a push pin or a rivet.

Statement 15. The system of any one of the statements 9-14, wherein the fastener extends laterally into the charge tube and the weight tube.

Statement 16. A method for adjusting perforation angles of a perforating tool, the method comprising: rotating a first tubular of the perforating tool relative to a second tubular of the perforating tool, the first and second tubulars comprising apertures, wherein a portion of the first tubular is disposed in the second tubular; aligning the apertures of the first and second tubular on both sides of the first and second tubulars; inserting a first component of a fastener into a first side of a first tubular and a first side of a second tubular through a first set of the apertures of the first and second tubulars; inserting a second component of the fastener into a second side of the first tubular and a second side of the second tubular through a second set of the apertures of the first and second tubulars; and securing the first component of the fastener to the second component of the fastener in an interior portion of the first tubular.

Statement 17. The method of the statement 16, further comprising rotating the first tubular about a longitudinal axis of the perforating tool to align the apertures of the first and second tubular on both sides of the first and second tubulars.

Statement 18. The method of the statement 16 or 17, further comprising threading the first component to the second component of the fastener.

Statement 19. The method of any one of the statements 16-18, further comprising adjusting a rotational orientation of charges disposed in the first tubular.

Statement 20. The method of any one of the statements 16-19, further comprising inserting the first and second components of the fastener laterally into the first and second tubulars relative to a longitudinal axis of the perforating tool.

Although the present disclosure and its advantages have been described in detail, it should be understood that various changes, substitutions and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A downhole perforating tool comprising:

a first tubular comprising an end including apertures extending along a circumference of the end;

a second tubular comprising apertures disposed on opposing sides of an end of the second tubular, the end of the first tubular disposed in the end of the second tubular, wherein the apertures of the first tubular are configured to align with the apertures of the second tubular upon movement of the first tubular; and a fastener comprising:

a first component configured to pass through the apertures on a first side of each of the first and second tubulars; and a second component configured to pass through the apertures on a second side of each of the first and second tubulars, wherein the second component is configured to receive the first component in an interior portion of the first tubular, wherein the second component and the first component are configured to secure an orientation angle of the first tubular relative to the second tubular.

2. The perforating tool of claim 1, wherein the first component comprises a threaded member.

3. The perforating tool of claim 1, wherein the second component comprises a barrel nut.

4. The perforating tool of claim 1, wherein the apertures of the first tubular are arranged in rows.

5. The perforating tool of claim 1, wherein each aperture of the first tubular corresponds with an orientation angle for the first tubular relative to the second tubular.

6. The perforating tool of claim 1, wherein the first tubular is 360° rotatable relative to the second tubular before fastening of the first tubular to the second tubular with the fastener.

7. The perforating tool of claim 1, wherein the first component comprises a push pin or a rivet.

8. The perforating tool of claim 1, wherein the fastener extends laterally into the first and second tubulars from opposite sides of the perforating tool.

9. A downhole perforating system comprising:

a charge tube comprising apertures extending along a circumference of the charge tube;

a weight tube comprising apertures disposed on opposing sides of the weight tube, the weight tube configured to adjust a center of gravity of the charge tube, wherein a portion of the charge tube is disposed in the weight tube, wherein the apertures of the charge tube are configured to align with the apertures of the weight tube upon movement of the charge tube or the weight tube, wherein the apertures are aligned in at least two rows, each row configured for rotational adjustment of the charge tube relative to the weight tube; and a fastener comprising:

an elongated member extending through the apertures of each of the charge tube and weight tube, wherein the elongated member secures an orientation angle of the charge tube.

10. The downhole perforating system of claim 9, wherein the apertures of the charge tube correspond with orientations angles of the charge tube ranging from 0° to 360° relative to the weight tube.

11. The downhole perforating system of claim 9, wherein the charge tube comprises at least one shaped charge.

12. The downhole perforating system of claim 11, wherein the weight tube comprises an adjustable weight.

13. The downhole perforating system of claim 9, wherein the apertures of the charge tube are arranged in staggered rows, each aperture of the charge tube corresponding with detonation orientation.

14. The downhole perforating system of claim 9, wherein a first component comprises a push pin or a rivet.

15. The downhole perforating system of claim 9, wherein the fastener extends laterally into the charge tube and the weight tube.

16. A method for adjusting perforation angles of a perforating tool, the method comprising:

rotating a first tubular of the perforating tool relative to a second tubular of the perforating tool, the first and second tubulars comprising apertures, wherein a portion of the first tubular is disposed in the second tubular;

aligning the apertures of the first and second tubular on both sides of the first and second tubulars;

inserting a first component of a fastener into a first side of a first tubular and a first side of a second tubular through a first set of the apertures of the first and second tubulars;

inserting a second component of the fastener into a second side of the first tubular and a second side of the second tubular through a second set of the apertures of the first and second tubulars; and securing the first component of the fastener to the second component of the fastener in an interior portion of the first tubular.

17. The method of claim 16, further comprising rotating the first tubular about a longitudinal axis of the perforating tool to align the apertures of the first and second tubular on both sides of the first and second tubulars.

18. The method of claim 16, further comprising threading the first component to the second component of the fastener.

19. The method of claim 18, further comprising adjusting a rotational orientation of charges disposed in the first tubular.

20. The method of claim 16, further comprising inserting the first and second components of the fastener laterally into the first and second tubulars relative to a longitudinal axis of the perforating tool.

* * * * *